United States Patent [19]

Nixon

[11] 4,010,592

[45] Mar. 8, 1977

[54] TEMPLATE FOR AND METHOD OF CUTTING COMPOSITION SHINGLES FOR RAPID AND SCRAP-FREE INSTALLATION

[76] Inventor: Roy Nixon, 133 W. Pole Road, Lynden, Wash. 98264

[22] Filed: Jan. 16, 1976

[21] Appl. No.: 649,849

[52] U.S. Cl. ..... 52/748; 30/124; 33/174 G; 33/188; 52/749; 269/295

[51] Int. Cl.[2] ..... E04D 3/32; E04D 15/02

[58] Field of Search ..... 33/82, 33, 174 G, 1 F, 33/DIG. 20, 187, 188, 108; 269/293, 295; 30/114, 124, 286; 52/748, 749, 518, 559

[56] References Cited

UNITED STATES PATENTS

| | | | |
|---|---|---|---|
| 569,947 | 10/1896 | Adler | 269/295 X |
| 807,817 | 12/1905 | Gilbert | 33/108 |
| 892,552 | 7/1908 | Rexer | 33/1 F |
| 1,612,390 | 12/1926 | Maynard | 269/295 |
| 2,271,728 | 2/1942 | Bainbridge | 52/105 |
| 2,602,232 | 7/1952 | Keast | 33/108 |
| 3,541,745 | 11/1970 | Probst | 52/105 |
| 3,797,122 | 3/1974 | Smith | 33/174 G |

*Primary Examiner*—Alfred C. Perham

[57] ABSTRACT

A template for use by a roofer enabling him to utilize three composition shingle units, each having three tabs, to start six rows of shingles on a gable type roof, and have no waste from the initial shingles. The template includes a main body portion having upstanding quick elements to assure proper orientation of the shingles and a plurality of guiding slots to assure shingles of the proper size.

8 Claims, 6 Drawing Figures

FIG. 1
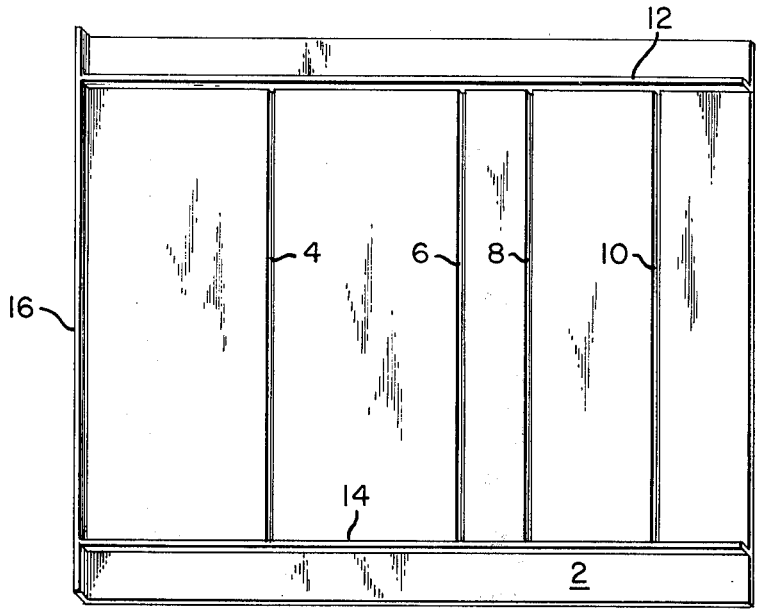
FIG. 2
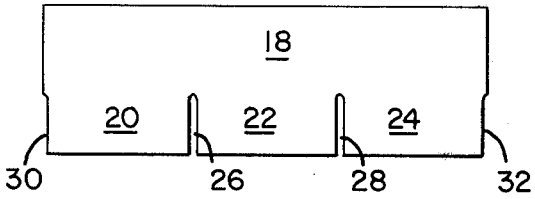
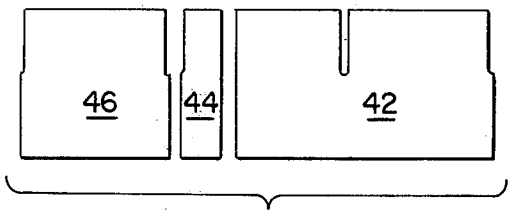
FIG. 5
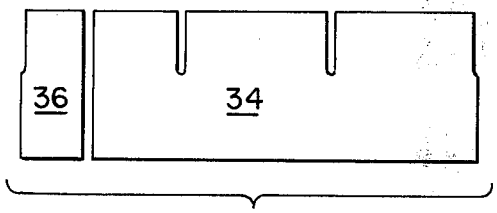
FIG. 3
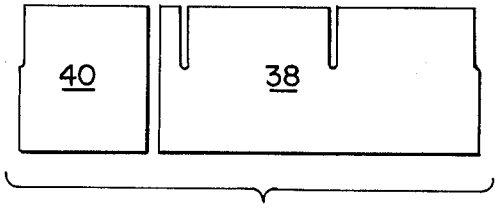
FIG. 4

TEMPLATE FOR AND METHOD OF CUTTING COMPOSITION SHINGLES FOR RAPID AND SCRAP-FREE INSTALLATION

BACKGROUND OF THE INVENTION

As is well known, over and above the obvious reasons for placing shingles upon a building, i.e. that of weather protection, it is highly desirable that the roofing be attractive and that there be as little material waste as possible during the installation. The advent of the composition shingle which covered a greater area with a single unit, allowed a roofer to more quickly place a roof upon a building thereby greatly decreasing the labor costs. The material cost of a composition roof is also less than that of a wooden shindle and therefore the composition shingle has become a highly desirable and much used roofing material.

One of the reasons the composition shingle takes fewer man hours or less labor time to place upon the roof is that fact that it comes with, in actuality as noted above, more than one shingle in a given shingling unit. Since the edges of a gabled roof are essentially in a straight line it is necessary to stagger the multi-shingle unit such that the artificial differentiation and/or slot for the shingles does not match-up with the slot of the shingle immediately adjacent thereto resulting in parallel unbroken lines. The staggering of the shingles is for esthetic purposes but primarily because the channels formed by the separation slots tend to be the collectors of the rain water run-off. It is desirable in terms of a long life for the roof to cause the run-off to flow from one collector to a broad non-collecting area. The flow from a collector to a non-collecting area also continually moves the run-off to stay at the outermost surface.

With this in mind it has been the practice of roofers to lay down the first row of shingles utilizing a full three shingle unit and then staggering each unit from this particular shingle, such that both the esthetic appearance and the weather resistance is maximized. One of the problems with the required staggering of the shingles is that this method of installation requires a roofer to cut a majority of the shingle units in order to properly begin each successive row. The necessity of cutting the units results in scraps which must either be discarded or transported to the other end of the roof. Even if the scraps are carried to the opposite end of the roof, this requirement results in a non-productive period for the individual doing the transporting.

With the above-noted problems and prior art in mind it is an object of the present invention to provide a template whereby a roofer, be he amateur or professional, can quickly and easily take multi-tab shingle units and precut them to the desired size. The proper cutting of the shingle units enables the roofing to be begun without any scrap material being wasted and/or carried to the other end of the roof.

It is still another object of the present invention to provide a template whereby the shingles are precisely cut to predetermined size such that the diagonal lines across the roof, formed by the line of slots or grooves, which differentiate the individual tabs, will be perfectly straight and thus pleasing to the eye.

Yet another object of the present invention is to provide a template which is straightforward and easy to use such that a novice roofer may prepare his shingles as quickly and easily as a professional thereby greatly decreasing the time involved and eliminating the waste.

Yet another object of the present invention is to provide a template which comprises a thin, flat, main body portion having a plurality of parallel slots therein and upstanding guide elements to assure the proper placement of the shingle and thus proper sized cut elements.

Still another object of the present invention is to provide a template whereby the template has an upstanding edge which abutts against the end of a composition shingle and includes a first slot parallel to the edge 5 ⅛ inches therefrom, a second slot parallel to the edge 5 ⅛ inches from the first slot, a third slot 1 6/8 inches from the second slot and a fourth slot 3 ⅜ inches from the fourth slot.

Still another object of the present invention is to provide a method for precutting shingles such that three composition shingles provide a start for six rows. The first shingle will be cut using the slot closest to the edge guide of the template. The second shingle will be cut using the guide slot second from the edge of the template and the third shingle will be cut utilizing the third and fourth slots cutting the shingle into three pieces. When placing the shingles upon the roof the bottom row will utilize a full shingle. The second row will utilize the largest piece following the first cut, the small piece being utilized for the last row. The second cut shingle unit will yield two pieces, the largest piece for the beginning of the second row and the smaller of the two pieces for the next to the last row. The third shingle cut will provide the third and fourth row.

Still another object of the present invention is to provide a means to cut shingles whereby three shingles are placed upside down upon a solid surface and a template having predetermined slots therein and guide edges placed above the shingles. The operator then makes one cut through the topmost shingle, removes the resultant pieces, makes one cut in the second shingle, removes the resultant pieces and makes two cuts in the third shingle removing said pieces and then utilizes the pieces to form six rows of shingles on a roof.

BRIEF DESCRIPTION OF THE DRAWINGS

FIG. 1 is a planar view of the template utilized in the present invention and in the method of applying roofing.

FIG. 2 is a view of a full composition shingle having three separate tabs.

FIG. 3 is a top view of a composition shingle following the first cut utilizing the inventive method.

FIG. 4 is a view of a composition shingle following the second cut utilizing the present inventive method.

FIG. 5 is a view of a composition shingle following the third and fourth cut utilizing the present inventive method.

DETAILED DESCRIPTION OF DRAWINGS

Figure 6:
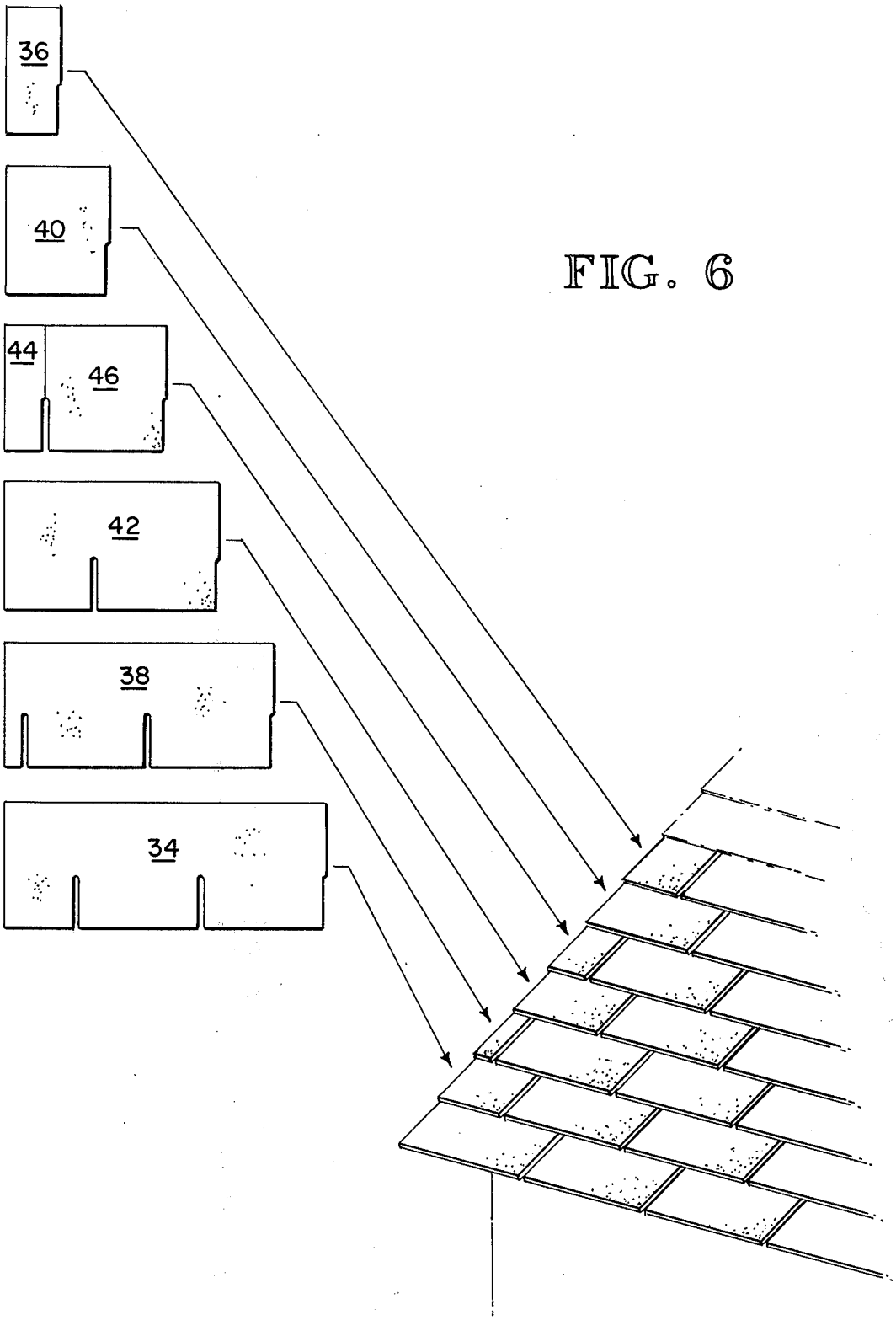
FIG. 6 is an exploded view showing the various cut shingles and their placement upon a composition roof utilizing said shingles and the inventive method of roofing.

As seen in FIG. 1 the template is a simple structure which may be fabricated of metal, stiff plastic or any other suitable material. As seen in this view it comprises a flat main body portion 2 having a plurality of slots 4, 6, 8, and 10 therein. It is to be noted that slots 4 through 10 do not extend the full width of the main portion but terminate at upstanding guide ridges 12 and 14 which extend in a direction perpendicular to the slots 4 through 10. Further to be noted is an end guide ridge 16 at the end of the template. The combination of the flat main body portion and the guide ridges provide an accurate means whereby shingles can be accurately cut as well as assuring rigidity of the main body portion and thusly a longer lasting, more easily used template.

It is to be noted that because of the particular size of the manufactured shingles it has been found that the distance between the upstanding edge 16 at the end of the main body portion and the first slot 4 should be 5 ⅛ inches. The distance between slot 4 and slot 6 should likewise be 5 ⅛ inches. The distance between slots 6 and 8 should be 1 ¾ inches. The distance between slots 6 and 8 should be 1 ¾ inches. The distance between slot 8 and slot 10 should be 3 ⅜ inches.

Utilization of the hereinabove described template and the cutting of three composition shingles thereby as described herein results in a plurality of shingles which are of such a size that they may immediately be placed upon a roof and form the beginning of six separate rows without a bit of waste material.

As is well known by roofers, the first or lowermost row upon a roofing job utilizes one composition shingle placed in an inverse or upside down position followed by a full shingle placed in an upright position. This gives the right side up shingle a base upon which to be applied and further assures that the roof will be of a uniform thickness and appearance since all of the subsequent shingles will overlap the row immediately therebelow. This first or full size shingle which is used to form the beginning of the first row is shown in FIG. 2 and as can be seen it comprises a main body portion 18 having three outwardly extending tabs 20, 22 and 24, slots 26 and 28 between the three tabs at two half slots at the end 30 and 32. As will be obvious, when two half slots are placed in adjacent position they will form a full slot thereby assuring that the roof will have a uniform appearance eventhough it is made up of many separate shingle units.

The first cut shingle as is shown in FIG. 3 utilizes the first slot in the template, i.e. 4, that which is 5 ⅛ inches from the upstanding ridge 16. The larger of the two pieces designated 34 is utilized to form the beginning of the second row of shingles. The smaller of the two pieces, designated as 36 is utilized to form the beginning of the last or sixth sequential row started by shingles cut utilizing the inventive template. The second cut shingle is then cut using slot 6 or that which is 10 ¼ inches from the edge 16. The larger of the two pieces, 38, is utilized to begin the third row and the smaller of the two pieces, 40 is utilized to form the start of the fifth or the next to the last row.

As noted above, the third shingle is cut utilizing two slots and the largest piece, i.e. that designated 42, is utilized to begin the third row and the two other pieces 44 and 46, are used together to form the fourth row. The reason for cutting the pieces as such, as noted above, to eliminate any scrap and further to assure that there will be a slot at all the necessary positions.

Referring now to FIG. 6 it can readily be seen that the process as described hereinabove quickly and easily renders a uniform and attractive roof. It is to be noted that all of the dividing slots appear in uniform lines, all of the shingles have their slots overlapping a smooth portion of the shingle immediately below and none of them are directly below another slot even when extended to the second or third row above the slot.

It can readily be seen, thereby that the utilization of the present invention a great deal of time and/or material is saved and an almost perfect re-roofing or roofing job results.

What is claimed is:

1. A template for utilization with multi-composition type shingles whereby the shingles may be cut for application in the most efficient and economical manner, comprising:
   a. a relatively thin main body portion having a plurality of parallel slots therethrough,
   c. a pair of spaced, parallel upstanding guide means extending outwardly from the same side of the main body portion and extending substantially the entire length thereof, and
   c. third guide means perpendicular to said spaced, parallel upstanding guide means, adjacent the edge of the main body portion a predetermined distance from the slots whereby a shingle placed adjacent the guide means can be cut, utilizing the slots (as guides) such that multiple rows of shingles may be begun at the edge of the roof with no shingle waste.

2. A template as in claim 1 wherein the parallel guide means extend the full length of the main body portion.

3. A template as in claim 1 wherein the parallel guide means are spaced inwardly from the edge of the main body portion.

4. A template as in claim 1 wherein the parallel slots extend between the parallel upstanding guide means.

5. A template as in claim 1 wherein the main body portion includes four parallel slots.

6. A template as in claim 5 wherein the slots are respectively spaced 5 ⅛ inches, 10 ½ inches, 12 inches and 15 ⅜ inches from the third guide means.

7. A method of preparing shingles for application to a gabled roof comprising the steps of:
   a. stacking three shingles, back side up and delineation slots facing away from operator,
   b. placing template having guides and slots on top of the stack,
   c. cutting the uppermost shingle into two pieces utilizing slot to guide the knife,
   d. cutting the second shingle into two pieces utilizing another slot to guide the knife, and
   e. cutting the third shingle into three pieces utilizing two additional slots as guides.

8. A method of applying shingles upon a gabled roof comprising the steps of:
   a. cutting three 18 inches composition shingles into seven pieces of the size 15 ⅜ inches, 12 inches, 1 ¼ inches 7 ¾ inches, 6 inches 5 ⅛ inches and 2 ⅝ inches respectively,
   b. using the cut shingles in the order of decreasing size to start the next seven rows following the first which utilizes a full width shingle, and
   c. repeating the process for each sequential set of eight rows or part thereof to be peak of the roof.

* * * * *